United States Patent [19]

Hornung et al.

[11] Patent Number: 4,911,047

[45] Date of Patent: Mar. 27, 1990

[54] SYNCHRONOUS ROTARY CROSS-CUTTER

[75] Inventors: Hans Hornung, Alsbach-Hähnlein; Bernd Fuchs, Darmstadt-Wixhausen; Eduard Voltz, Darmstadt, all of Fed. Rep. of Germany

[73] Assignee: Valmet-Strecker GmbH, Pfungstadt, Fed. Rep. of Germany

[21] Appl. No.: 199,014

[22] Filed: May 26, 1988

[30] Foreign Application Priority Data

Jun. 4, 1987 [DE] Fed. Rep. of Germany ..... 3718776

[51] Int. Cl.[4] ..... B26D 1/40

[52] U.S. Cl. ..... 83/342; 83/284; 83/344; 83/672; 83/699

[58] Field of Search ..... 83/304, 305, 340, 341, 83/342–345, 672, 674, 284, 699

[56] References Cited

U.S. PATENT DOCUMENTS

| | | | |
|---|---|---|---|
| 1,304,034 | 5/1919 | Edwards | 83/304 |
| 1,910,387 | 5/1933 | Hahn | 83/674 |
| 1,965,523 | 7/1934 | MacFarren | 83/305 |
| 3,247,746 | 4/1966 | Nystrand | 83/342 |
| 3,606,811 | 9/1971 | Hallden | 83/305 |

FOREIGN PATENT DOCUMENTS

| | | | |
|---|---|---|---|
| 814236 | 7/1951 | Fed. Rep. of Germany . | |
| 933010 | 8/1955 | Fed. Rep. of Germany . | |
| 1427167 | 4/1969 | Fed. Rep. of Germany | 83/677 |
| 2244747 | 8/1974 | Fed. Rep. of Germany . | |

*Primary Examiner*—Hien H. Phan

*Attorney, Agent, or Firm*—Karl F. Milde, Jr.

[57] ABSTRACT

A synchronous rotary cross-cutter is disclosed with two oppositely rotated, axially parallel cutting rotors that support cooperating, helically extending knife blades with cutting edges situated in a cylindrical envelope. The axes of these cutting edges run at an angle, corresponding to the inclination of the helix, with respect to the direction of advancement of the material web being cut. To accommodate different cutting lengths without the need for a controllable irregular drive for this purpose, the axial distance of the cutting rotors from the material web is variable and the knives are mounted on a flat blade holder that runs substantially tangentially in the rotor cross section and is slightly flexible. The knife blade holder, supported by a series of individually adjustable supporting elements, can be given a slight flexure with a radial adjustment, so as to assure that the position of the cutting edge of the knife remains within in the cylindrical envelope. Preferably, the supporting elements consist of supporting shanks which can be clamped in a beam-like hub body of the cutting rotor and which alternate with screw spindles that form the adjusting means.

18 Claims, 5 Drawing Sheets

SYNCHRONOUS ROTARY CROSS-CUTTER

BACKGROUND OF THE INVENTION

The invention relates to a synchronous rotary cross-cutter of the type having two oppositely rotated, axially parallel cutting rotors that support cooperating, helically extending knife blades with cutting edges situated in a cylindrical envelope. The axes of these cutting edges run at an angle, corresponding to the inclination of the helix, with respect to the direction of advancement of the material web being cut.

A synchronous cross cutter of this kind is disclosed, for example, in the German Pat. No. 814,236. This device makes it possible to achieve a clean, shearing cut without having to accept a large cutter overlap at the beginning of the knife, which is structurally undesirable in the case of a relatively large material web width. On the other hand, adaption to different cutting lengths is possible with this device only by means of a relatively complex, controllable irregular drive, such as the on described, for example, in the German Pat. No. 933,010.

Synchronous rotary cross cutters with straight knives, which have a knife overlap that increases with the cut width, are thus limited in regard to the width of material web to be cut. On the other hand, it is known from German Pat. No. 2,244,747 to vary the radius of the knives with respect to each particular cutting rotor axis together with the distance of the cutting rotor axes from the material web to accommodate different cutting lengths.

SUMMARY OF THE INVENTION

It is a principal object of the present invention to transfer this relatively simple measure, employed in the device disclosed in the German Pat. No. 2,244,747, to a synchronous cross-cutter with two oppositely rotated axially parallel cutting rotors. For this purpose it is necessary to overcome the problem that, in the case of helically extending knife blades, their radial curvature must be adapted to the particular cylindrical envelope.

This object, as well as other objects which will become apparent from the discussion that follows, are achieved, according to the present invention, by constructing the cross-cutter in such a way that the axial distance of the cutting rotors from the material web is variable and the knifes are mounted on a flat knife blade holder that runs substantially tangentially in the rotor cross section and is slightly flexible. The knife blade holder, supported by a series of individually adjustable supporting elements, can be given a slight flexure with radial adjustment, so as to assure that the position of the cutting edge of the knife remains within a cylindrical envelope. Preferably, the supporting elements consist of supporting shanks which can be clamped in a beam-like hub body of the cutting rotor and which alternate with adjusting means in the form of screw spindles.

The point-by-point support of the flexible knife holders makes it possible, in the case of variation of its radius, i.e., its distance from the cutting rotor axis, to give the knife blades a curvature adapted in axial projection to the curvature of the particular cylindrical envelope.

For a full understanding of the present invention, reference should now be made to the following detailed description of the preferred embodiments of the invention and to the accompanying drawings.

DESCRIPTION OF THE PREFERRED EMBODIMENTS

Figure 1:
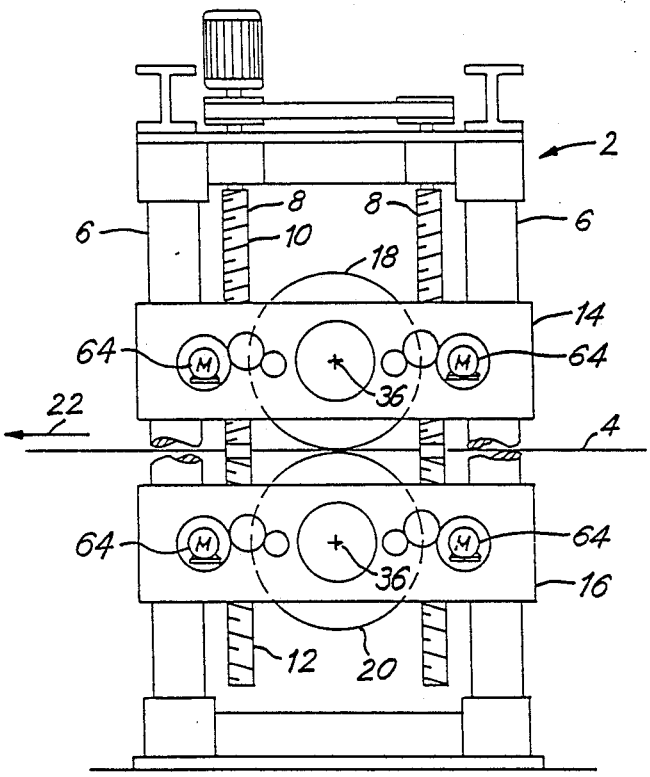
FIG. 1 is a side elevational view of a cross cutter according to a first preferred embodiment of the invention, as seen in the direction of the axes of the cutter rotors.
Figure 2:
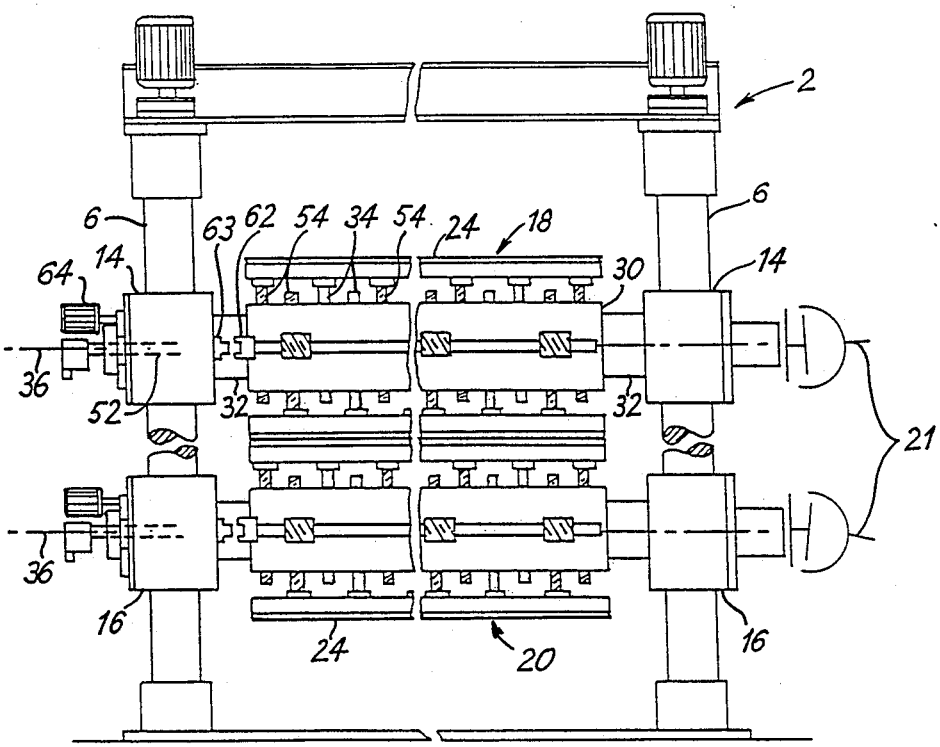
FIG. 2 is a front elevational view of the cross cutter of FIG. 1, as seen in the direction of movement of the material web being cut.

The synchronous cross-cutter shown in FIG. 1 has a frame 2 with four columns 6 disposed in pairs on either side of the material web 4 passing horizontally through them. Two opposed bearing blocks 14 and 16, supported by these columns, are adjustable vertically with respect to each other by means of synchronously motor driven screw spindles 8. Two cutter rotors 18 and 20 (indicated only diagrammatically in FIG. 1) are journaled in the bearing blocks 14 and 16 on both sides thereof. These rotors are connected to one another in a conventional manner by a common drive 21 (FIG. 2) not shown in detail.

The cross cutter is constructed, with respect to the direction of movement of the material web 4 as indicated by the arrow 22, such that the too, parallel axes of the two cutter rotors 18 and 20 assume, in the plane of the material web 4, an angle that is slightly offset from a right angle and corresponds to the inclination of the helically twisted knife blades 24 of the two cutter rotors (to be further discussed below).

As can be seen in FIGS. 2 to 5, each of the two cutter rotors 18 and 20 has a central, beam-like hub body 30, and journals 32 at both ends as required for mounting and driving the cutter rotors. In the hub body there are mounted a series of supporting shanks 34 running crosswise substantially radially of the rotor axis 36, which can be gripped laterally by jaws 38. The jaws 38 are subject to the action of plate springs 40 in blind holes 42 in the hub body 30. These plate springs normally urge the jaws against the supporting shanks 34. However, in order to remove this bias and release the supporting shanks, the jaws 38 are connected by rods 44 and levers 45 to a plate 46 running along the hub body 30. Between the hub body 30 and plate 46 is disposed a flexible tube 50 which is closed at one end and which can be filled with compressed air from its other end from an axial bore 52 (FIG. 2) through one of the journals 32. When this occurs, the inflating tube 50 presses the plate 46 away from the hub body 30 thereby lifting the jaws 38 away from the supporting shanks 34 by overcoming the force of the plate springs 40.

Figure 5:
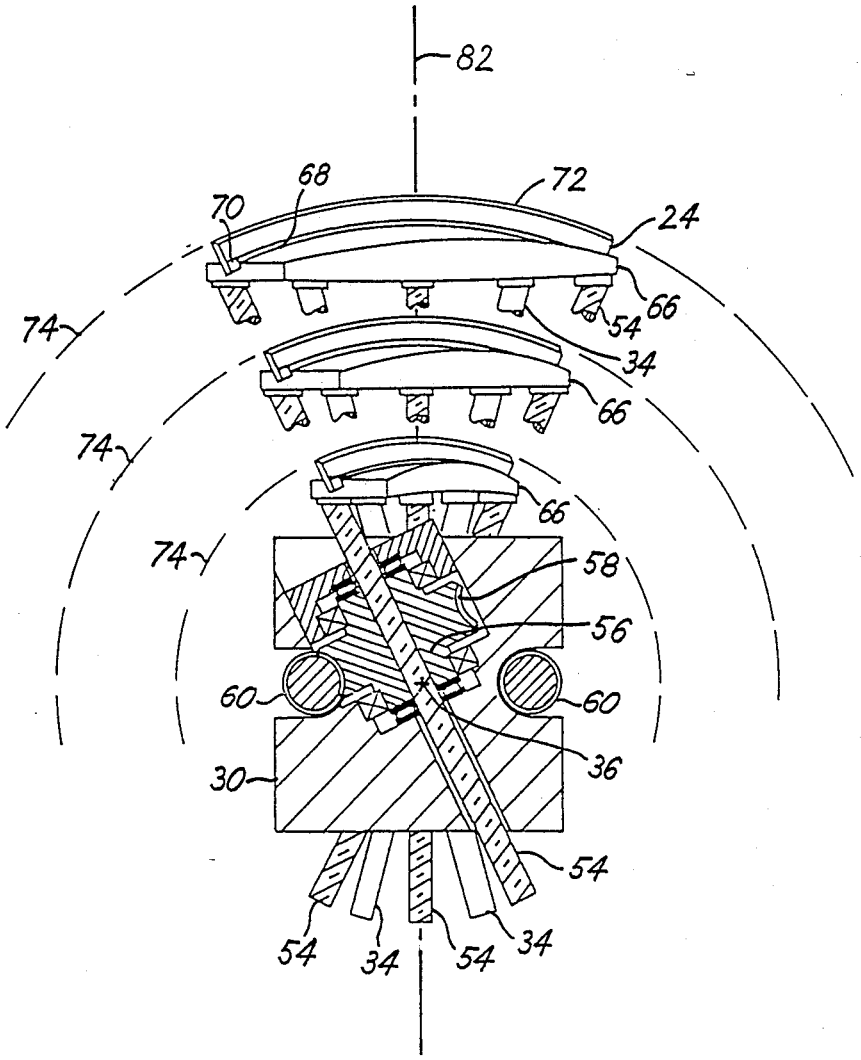
FIG. 5 is an end view of a cutter rotor similar to that of FIG. 4, showing a second embodiment, partially sectioned, in which the second knife blade together with the parts bearing this blade are omitted for the sake of clarity.

Between the supporting shanks 34, screw spindles 54 are journaled in the hub body (FIGS. 2, 3 and 5) and are surrounded in their threaded portion by nuts 56 which are mounted rotatably but axially undisplaceably in the hub body (FIG. 5). Half the number of the nuts 56 support on their circumference a worm gear 58 which meshes with one of two worms 60 running lengthwise through the hub body 30. Likewise, such a worm gear 58 on the other half of the nuts 56 meshes with the second worm 60. The worms 60 support clutch jaws 62 at their one end (FIG. 2) by which they can be coupled with corresponding clutch jaws 63 of a stepping drive 64. As can be seen, rotating the worms 60 permit the spindles 54 to be shifted together transversely of the hub body 30. In order to adapt their shifting movement individually to the particular requirements (which will be dealt with later on) the spindles 54, together with the nuts 56 have different thread pitches.

The supporting shanks 34 and spindles 54 are disposed symmetrically on two diametrically opposite sides of the rotor axis 36. The supporting shanks 34 of each side support at their free end a flat, rather bar-like knife holder 66. Each knife holder 66 contains on its outer side a groove 68 which runs to a slight extent helically about the rotor axis 36, and in which a knife 24 is gripped by means of a wedging bar 70. The cutting edges 72 of the two knives 4 are situated in a cylindrical envelope 74 of which several are indicated in broken lines in FIGS. 3 to 5. To permit this adjustment, independently of the radius, the knife holders 66 are able to be slightly bent in addition to their radial adjustment by the screw spindles 54 (as indicated in FIGS. 4 and 5) and held in this state by means of supporting shanks 34 locked up by the clamp jaws 38.

Figure 3:
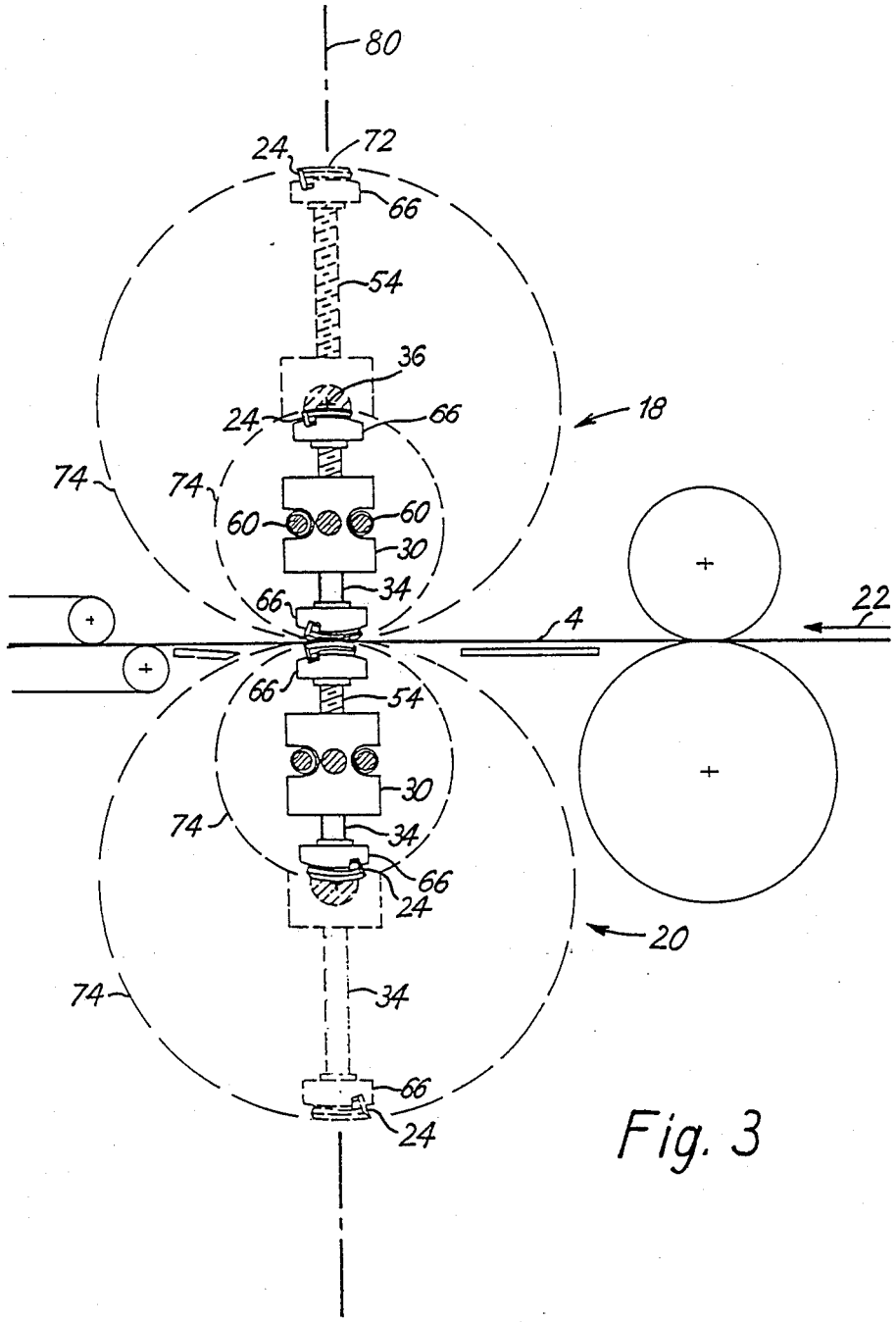
FIG. 3 is an end view of the two cutter rotors of the cross cutter of FIG. 1, partially in section.
Figure 4:
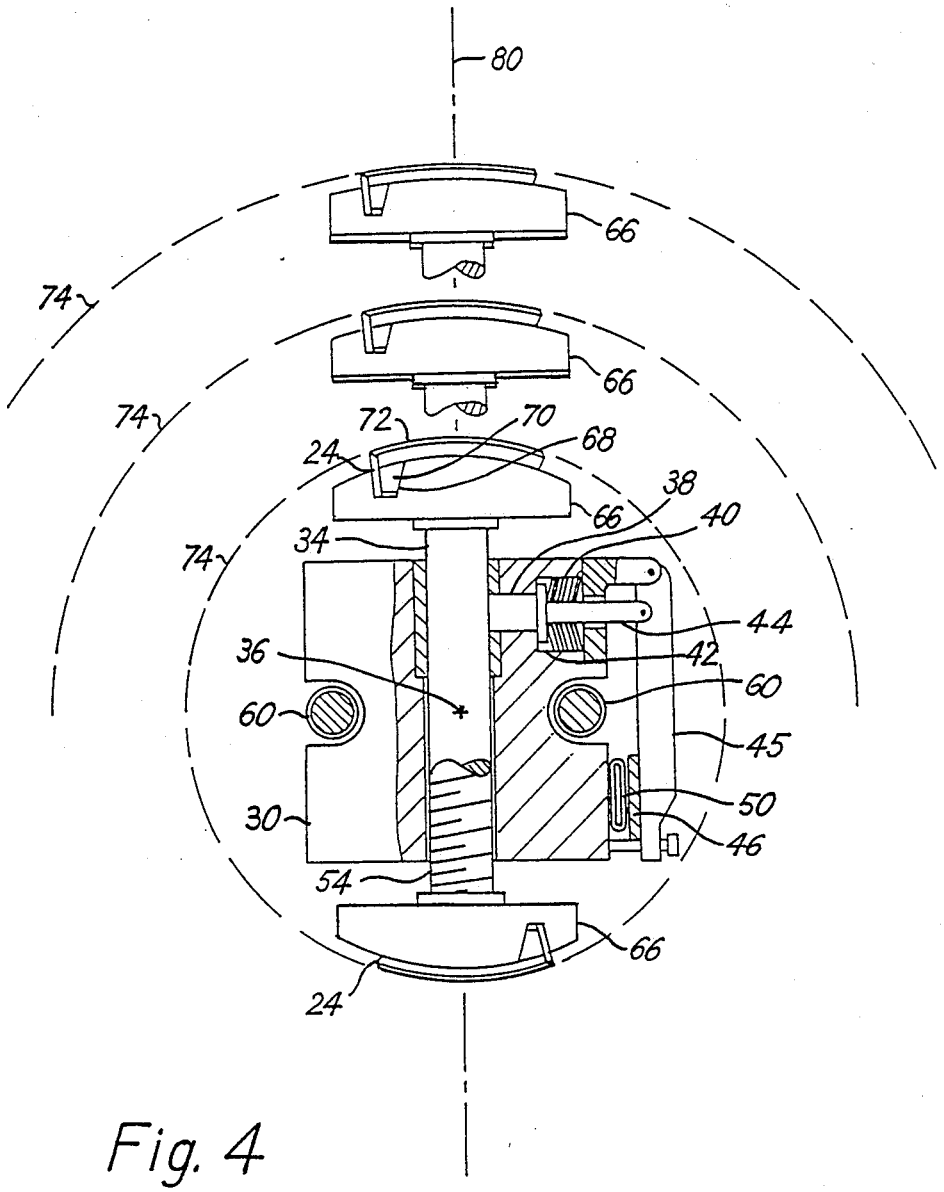
FIG. 4 is an enlarged end view of one of the cutter rotors according to FIG. 3, partially sectioned in a different plane.

The two embodiments according to FIGS. 3 and 4 on the one hand, and FIG. 5 on the other, differ in that the supporting shanks 34 and screw spindles 54 are disposed in the one case parallel to one another in a common plane that is radial with respect to the rotor axis, as indicated at 80 in broken lines in FIGS. 3 and 4, while in the other case they are disposed substantially radially with respect to the rotor axis 36 and in a spiral, fan-like configuration. Accordingly the knife holder 66, as shown in FIGS. 3 and 4, undergoes only a translatory movement in its radial adjustment, aside from the above-mentioned slight bending, while according to FIG. 5 it undergoes not only the radial adjustment but also a rotation about an axis 82 that is perpendicular to the rotor axis 36 such that it is increasingly bent as the radius increases with respect to the rotor axis. In any case this achieves the objective that, as stated, the cutting edges 72 of the knives 24 remain within the cylindrical envelope surface such as indicated at 74.

For greater cutting lengths, one of the two knives 24 of each of the rotors 18 and 20 can be inactivated in a conventional manner by simply retracting the knife holder 66 slightly by means of the screw spindles 54. The cutting lengths which are thereby achievable preferably will be continuous with the cutting lengths which are achievable with two knives that are in use. In other words, the smallest possible envelope cylinder radius is to amount to about half of the largest. It is to be understood that, with each change in the envelope cylinder radius, the distances between the rotor axes and the plane of the material web 4 also must be changed by means of the screw spindles 8.

There has thus been shown and described a novel synchronous rotary cross-cutter which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention which is limited only by the claims which follow.

What is claimed is:

1. In a synchronous rotary cross-cutter comprising two oppositely rotated, parallel-axis cutting rotors that support helically extending knife blades which come progressively into overlap from one end to the other and have their cutting edges situated in a cylindrical envelope, the rotor axes being at an angle in accordance with the pitch of the helix to the direction of feed of the material web to be cut which passes between the cutting rotors, the improvement, to accommodate different cutting lengths of the material web, wherein the distance of the rotor axes (36) from the material web (4) is variable; wherein the knife blades (24) are mounted each on a flat, slightly flexible knife holder (66) which extends substantially tangentially in the rotor cross section and is radially adjustable with respect to the respective rotor axis (35); and wherein the knife holders (66) are each supported by a series of individually adjustable supporting elements (34), the adjustment of which is automatically controlled such that with each radial adjusting the knife holders undergo a flexure to a degree that the knife cutting edges (72) remain in the respective cylindrical envelope (74).

2. The synchronous rotary cross-cutter defined in claim 1, wherein said supporting elements each comprises at least one supporting shank (34) clampably mounted in a beam-like hub body of each cutting rotor.

3. The synchronous rotary cross-cutter defined in claim 2, wherein the supporting shanks (34) are anchored in a laterally undisplaceable manner on the knife blade holder (66).

4. The synchronous rotary cross-cutter defined in claim 3, wherein the supporting shanks (34) running substantially radially with respect to the rotor axis (36) occur in a helically twisted, fan-like arrangement.

5. The synchronous rotary cross-cutter defined in claim 2, wherein the supporting shanks (34) extend parallel to one another in a common plane (80) radial with respect to the rotor axis (36) and the knife blade holder (66) is guided running parallel to the rotor axis (36).

6. The synchronous rotary cross-cutter defined in claim 2, further comprising means for clamping and releasing the supporting shanks (34) in unision.

7. The synchronous rotary cross-cutter defined in claim 6, wherein said clamping means include spring means for applying a mechanical spring force to the supporting shanks (34).

8. The synchronous rotary cross-cutter defined in claim 6, wherein said releasing means include fluid-operated means for selectively applying a counterforce.

9. The synchronous rotary cross-cutter defined in claim 18, wherein said fluid-operated means is pneumatically operated.

10. The synchronous rotary cross-cutter defined in claim 18, wherein said fluid-operated means is hydraulically operated.

11. The synchronous rotary cross-cutter defined in claim 1, wherein, in addition to its flexure, the knife blade holder (66) is guided to undergo a twisting with its radial adjustment such that, with increasing radius of the cutting edge of the respective knife blades with respect to the rotor axis, the knife blade holder is increasingly twisted with respect to the rotor axis (36).

12. The synchronous rotary cross-cutter defined in claim 2, wherein the supporting shanks (34) are arranged in alternating relationship with actuating means (54) for adjusting the position of the respective, corresponding section of the knife blade holder (66).

13. The synchronous rotary cross-cutter defined in claim 12, wherein the actuating means comprises screw spindles (54).

14. The synchronous rotary cross-cutter defined in claim 13, wherein the screw spindles (54) are commonly adjustable and have different thread pitches according to their different required strokes.

15. The synchronous rotary cross-cutter defined in claim 14, wherein the screw spindles (54) are surrounded by nuts (56) mounted rotatably but undisplaceably in the hub body, which have o their circumference a worm gear (58) meshing with a common worm spindle (60).

16. The synchronous rotary cross-cutter defined in claim 15, wherein the worm spindle (60) can be coupled with an external adjusting drive (64) when the respective cutting rotor (18, 20) is at rest.

17. The synchronous rotary cross-cutter defined in claim 1, wherein the knife blade holders (66) have a helix-shaped groove for the form-fitting accommodation of the corresponding knife blade (24), and wherein the knife blades themselves are initially rectilinear before insertion in the groove.

18. The synchronous rotary cross-cutter defined in claim 1, wherein each cutting rotor(18, 20) has two knife blade holders (66) with knife blades (24) diametrically opposite one another, each independently adjustable.

* * * * *